US007980254B2

(12) United States Patent
Callahan

(10) Patent No.: US 7,980,254 B2
(45) Date of Patent: Jul. 19, 2011

(54) THIN HAIR HOLDER AND ENHANCER AND METHOD THEREFOR

(75) Inventor: Deirdre Julia Callahan, Haverford, PA (US)

(73) Assignee: DeirdreJulia, Inc., Haverford, PA (US)

( * ) Notice: Subject to any disclaimer, the term of this patent is extended or adjusted under 35 U.S.C. 154(b) by 641 days.

(21) Appl. No.: 11/907,991

(22) Filed: Oct. 19, 2007

(65) Prior Publication Data

US 2008/0035164 A1 Feb. 14, 2008

Related U.S. Application Data

(63) Continuation-in-part of application No. 11/100,182, filed on Apr. 6, 2005, now abandoned.

(51) Int. Cl.
*A45D 8/00* (2006.01)
*A45D 8/12* (2006.01)

(52) U.S. Cl. ..... 132/273; 132/275

(58) Field of Classification Search ..... 132/273, 132/275, 54–56, 246, 245, 262, 120, 212, 132/222

See application file for complete search history.

(56) References Cited

U.S. PATENT DOCUMENTS

| | | | | |
|---|---|---|---|---|
| 1,974,460 | A * | 9/1934 | Isaacs | 132/246 |
| 2,595,657 | A * | 5/1952 | Harmon | 132/273 |
| 3,301,265 | A | 1/1967 | Brenn-Albertoni | |
| 5,499,638 | A | 3/1996 | Ripley | |
| 5,662,128 | A | 9/1997 | Habibi | |
| 5,799,672 | A | 9/1998 | Hansbury | |
| 6,269,488 | B1 * | 8/2001 | Jurgensen et al. | 2/171 |
| 6,691,714 | B1 | 2/2004 | Yaguchi et al. | |
| 2004/0154631 | A1 * | 8/2004 | Nawrocki | 132/262 |
| 2005/0039771 | A1 | 2/2005 | Crowley et al. | |
| 2006/0157078 | A1 | 7/2006 | Tojo et al. | |

* cited by examiner

*Primary Examiner* — Robyn Doan

(74) *Attorney, Agent, or Firm* — Breiner & Breiner, L.L.C.

(57) ABSTRACT

A hair fastening and hair volume enhancing device is described which includes a thin flat strip, of bendable, light-weight flexible material having bristles on top and bottom sides thereof. A wire is positioned between sheaths of material forming the thin flat strip. The flat strip has a surface finish of a color and shine similar to a wearer's hair color and shine so that the device is imperceptible when worn by the wearer. A hair fastening and hair volume enhancing method using the device involves placing the hair device in hair, moving and/or bending the hair device in any direction, and attaching the hair to the device by means of the bristles on the surfaces of the hair device such that the hair device holds hair in place while also providing hair enhancement by holding the hair in a suspended position away from the scalp, thereby enhancing hair volume appearance while also holding hair in place.

11 Claims, 2 Drawing Sheets

THIN HAIR HOLDER AND ENHANCER AND METHOD THEREFOR

RELATED APPLICATIONS

This application is a continuation-in-part of U.S. Ser. No. 11/100,182, filed Apr. 6, 2005, now abandoned entitled THE THIN HAIR HOLDER ENHANCER METHOD AND DEVICE.

FIELD OF INVENTION

This invention relates to hair holding and enhancing devices, specifically to a hair fastening device.

BACKGROUND OF THE INVENTION

Men and women with sparse and thin hair have difficulty styling their hair because they have little hair to style. For purposes of description herein, sparse, thin hair will hereafter be referred to as "thin hair" and adults having such hair will be referred to as "thin haired adults".

Thin hair characteristically lies flat against the skull, hangs limply against the face, or floats distractingly around the head. Thin haired adults are vexed in grooming their hair and have two major problems: they have difficulty creating the appearance of hair volume (hereafter called the "Volume Problem") and they have difficulty holding their hair in place (hereafter called the "Holding Problem").

The Volume Problem and the Holding Problem have historically been insoluble problems for thin haired adults. Prior hair fastening devices have not solved these problems. Prior art devices accommodate three classes of persons, namely: babies, little girls and women fortunate enough to have hair sufficient to support a hair device.

Prior art hair fastening devices, such as bobby pins, barrettes, and hair combs, slide out of thin hair and for the brief period of time these devices stay in the hair, they tend to flatten the hair and expose the scalp. Other hair fastening devices, such as hair bands, pony tail holders, and hair clip devices, have other deficits in thin hair.

When worn by a thin haired adult, hair bands, pony tail holders, and hair clips are uncomfortable and unattractive. Pony tail holders pull and tear thin hair. Hair clips are sharp and uncomfortable against the scalp. On a thin haired adult, all of preceding devices advertise the wearer's scarcity of hair.

Although some prior art hair devices propose to hold thin hair in place, they succeed only in the hair of babies, little girls and women who desire to display ornaments in their hair. These prior art devices have lightweight structures, unattractive fastening mechanisms, and decorative components that both hide the fasteners and decorate the head. When worn by a thin haired adult, the devices are highly visible in the hair, displaying ribbons, bows, plastic flowers or beads in the hair, thus rendered a juvenile presentation.

Examples of these prior art devices for thin hair include—

U.S. Pat. No. 4,896,685 issued Jan. 30, 1990,

U.S. Pat. No. 6,131,585 issued Oct. 17, 2000, and

U.S. Patent Application Publication No. 2003/0172948 A1 published Sep. 18, 2003.

In many societies, highly visible hair devices have a juvenile and feminine connotation that prohibits male use. Additionally, many women believe highly visible hair devices project appearances that are "little girlish" or unsophisticated. For these and other reasons discussed below, recent hair fasteners proposed for thin hair have been useless to thin haired adults.

The devices of U.S. Pat. No. 4,896,685 and U.S. Patent Application Publication No. 2003/0172948 A1 are made of flexible lightweight materials; and use hook and loop fabric sandwiches with the hair squeezed in the middle to hold the hair in place. Using hook and loop fabric sandwiches to hold hair in place causes both discomfort and hair loss when the devices are removed. Anyone who has ever had sweater fibers become entangled in a hook and loop sandwich neck tab on a winter jacket, may tell you what happens to the fibers so entangled. When the hook and loop neck tab is torn apart in jacket removal, the sweater fibers also tear. They remain in the hook and loop sandwich. The same happens to hair held in a hook and loop hair fastener.

The hair device of U.S. Pat. No. 6,131,585 does not hold hair in place but rather holds ornaments in the hair by means of little anchors. The anchors are made of little plastic discs having hook faced fabric glued to their surfaces. The anchors are unattractive and, therefore, must be buried under the hair. The anchors have ornaments attached either by glue or by string to their top or side surfaces. The anchors secure ornaments in the hair but do not hold hair in place at all. On a thin haired adult the anchors are visible and unattractive.

The inventor of the hair fastener that is the subject of this patent application is a thin haired adult who has tested and worn without success, all of the devices discussed above. No prior art hair fastening or hair ornament device has solved the Volume Problem or the Holding Problem experienced by thin haired adults.

When worn by thin haired adults, the prior art hair fastening devices either accentuate the wearer's scarcity of hair or are unattractive, uncomfortable, juvenile in appearance, feminine in connotation, or visible when worn.

SUMMARY OF INVENTION

Accordingly, several objects and advantages of the present invention to provide a hair fastening device include that the device (i) holds thin hair in place while enhancing the appearance of hair volume; (ii) is attractive when worn; (iii) is comfortable to wear and to remove; (iv) is culturally appropriate for adults to wear; (v) may be worn by men and women; (vi) is imperceptible to observers when worn by both men and women; (vii) enables women with thin hair to style and wear upswept hairstyles that could not previously be achieved with prior art devices; and (viii) enables a wearer to secure artificial hair to his/her own hair.

In accordance with the present invention, the thin hair holder and enhancer is a hair fastening device including a body that is the shape of a prickly thin strip, such prickly strip having a composition and consistency that is a bendable, flat, flexible, lightweight, thin material, that when bent is capable of maintaining the shape it has been bent into by the wearer, and has bristles on at least top and bottom surfaces of the body. The device additionally preferably has coloration and/or shine that is susceptible to making the bristled strip imperceptible when placed in the hair of a wearer, i.e., of a color and shine comparable to or the same as the wearer's hair so as to blend into the hair.

Further objects and advantages of the thin hair holder and enhancer will become apparent from the drawings and ensuing description.

DETAILED DESCRIPTION OF INVENTION

All dimensions stated and all description of materials employed are provided as examples only and are not intended to limit the scope of the present invention, as other materials and other dimensions may be used.

A preferred embodiment of the thin hair holder device of the invention is described below.

Figure 1:
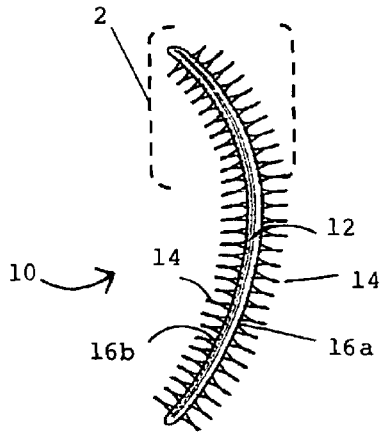
FIG. 1 shows a side view of a first embodiment of the thin hair holder device of the invention.
Figure 8:
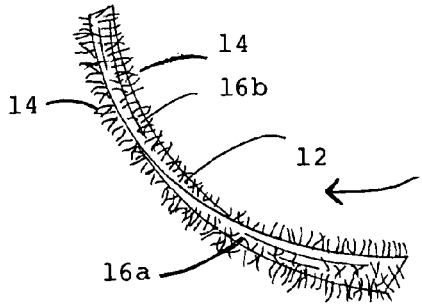
FIG. 8 shows a perspective view of the hair holder device when twisted and bent.

FIGS. 1 and 8 show a preferred embodiment of the thin hair holder and enhancer device. The device includes a body 10 including a thin strip 12. The strip 12 is made of a bendable, flat, flexible and lightweight material having bristles 14 on each of its top 16*a* and bottom 16*b* surfaces thus being a dual bristled surfaced strip. The bristles may be in the form of straight or looped extensions on the body. The strips can be colored and have a shine comparable to a wearer's hair color so that the device blends into the hair and is imperceptible to an observer in use.

Figure 2:
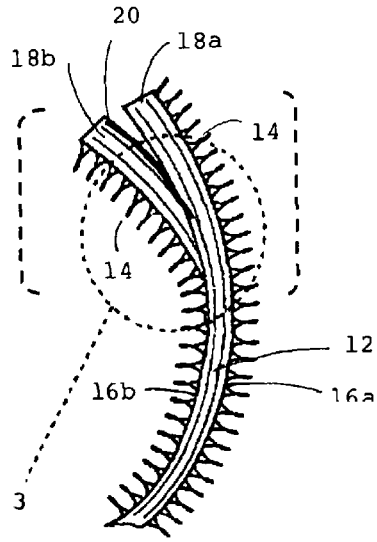
FIG. 2 shows a partial exploded view of the device of FIG. 1, including separate bristled sheaths, and wire positioned between the separate bristled sheaths.

FIG. 2 shows a partial exploded view of section 2 of the hair holder device shown in FIG. 1. The hair holder device's dual bristled strip shaped body is composed of a dual bristled strip 12 of material. The dual strip of material has a first strip of material and a second strip of material, each strip of material having a first longitudinal side edge and substantially smooth surface and a second longitudinal side edge and surface with bristles extending therefrom. The dual strip of material includes including preferably two sheaths 18*a* and 18*b* of separate, identical, bendable, flat, flexible, lightweight, thin material. Each sheath has a plurality of bristles 14 on one surface, and each such sheath has an opposite-side that is smooth.

FIG. 2 shows the bristled sheaths 18*a* and 18*b* have a wire 20 sewn or woven or otherwise positioned between the sheaths so as, when the sheaths attach together, the wire is positioned between and along the longitudinal edges of the sheaths having a smooth surface to form a single dual bristled surfaced strip 10 having bristles on its top and bottom surfaces. An alternative structure may include a flexible material that is woven to have a dual bristled surface with a wire woven within the flexible material of the dual bristled surface fabric.

Figure 3:
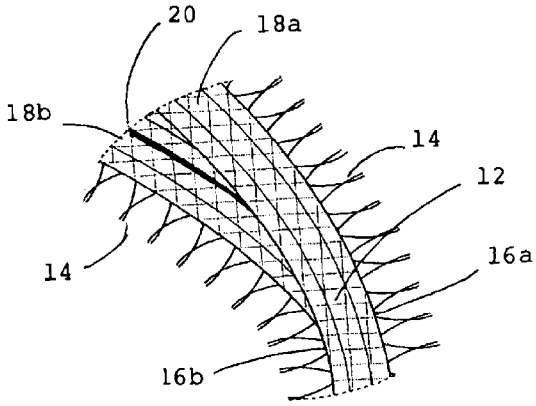
FIG. 3 shows a detailed view of the bristled sheaths in FIG. 2.

FIG. 3 shows a detail of the hair holder device as within the circled portion 3 of FIG. 2.

Figure 4:
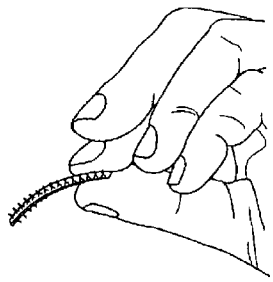
FIG. 4 shows the thin hair holder device as flexible and bendable.

FIG. 4 shows the device 10 as may be bent in use of the hair holder of FIG. 1.

Figure 5:
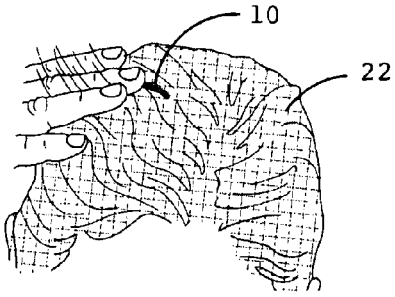
FIG. 5 shows use of the hair holder device in short hair as common to men.

FIG. 5 shows placement of the thin hair holder device on a person with short hair 22, the device having matching coloration to the color of the hair of the wearer of the device.

Figure 6:
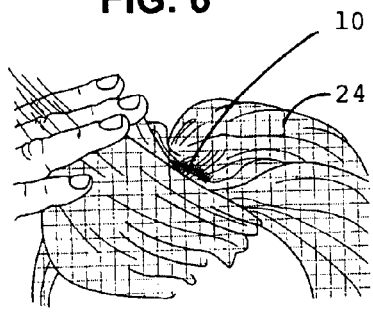
FIG. 6 shows use of the hair holder device in longer hair as common to women.
Figure 7:
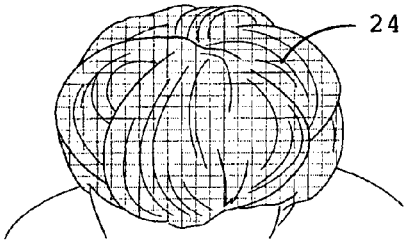
FIG. 7 shows the hair holder device in use and imperceptible to observers when hair covered.

FIG. 6 shows placement of the thin hair holder device on a person with long hair 24. The hair may be wrapped around the device so as to be imperceptible to observers when worn as shown in FIG. 7 due to the device's size, shape and color and shine so as to match a wearer's hair.

FIG. 8 further shows the flat and flexible nature of the thin hair holder device 10.

The thin hair holder device of the invention may be of various lengths and may be bent into different shapes.

A preferred embodiment of the thin hair holder device is as follows:

width of as thin as 0.2 cm (size of a toothpick), length of 3 cm to 15 cm (length of one toothpick or 5 toothpicks end to end), a more preferred length being approximately a length of 5 cm, and weight as little as 1.7 gms. (weight less than a toothpick).

The above sizing is an average size useful for both short and long hair.

The preferred embodiment of the thin hair holder device can be made of two sheaths of a bristled material, such as found in self-holding curlers, sewn together back to back, smooth side to smooth side facing inward, bristles facing outward, with a wire sewn between the bristled sheaths.

The bristled sheaths can be attached to each other by sewing the smooth sides of two separate bristled sheaths together, with a wire between the two sheaths so as to be held in place between the sheaths following joinder by sewing, cutting the sheaths into very thin strips (approximate width of a toothpick to an approximate width of a cassette recording tape) and applying to the finished strips a camouflaging solution, i.e. a solution with a colorant and/or a lightweight reflective metallic paint to provide the device with coloration and shine similar to the color and shine of a prospective wearer's hair.

FIG. 5 shows the use of the thin hair holder device 10 in the short hair 22 of a man. When placed in the hair and moved in any direction, hair contacting the thin hair holder device attaches to and remains attached to the bristles on the surfaces of the thin hair holder device. When covered with a few strands of hair, the thin hair holder device is imperceptible to observers. Hair is held in place by means of the hair attachment to the bristles on the surfaces of the thin hair holder device.

The device enhances the appearance of hair by increasing the hair's volume by means of the natural raising of hair strands when they become enmeshed in the bristles of the thin hair holder device. Volume is further enhanced by means of the continual maintenance of the hair in such suspended position indefinitely by the bristles to which the hair has attached. Hair volume, as shown in FIG. 7 is also enhanced by the placement of the device under the surface of the hair and bending the thin hair holder device to any shape, while being imperceptible to observers.

FIG. 6 shows the operation of the thin hair holder device in the long hair 24 of a woman which is identical in manner of operation of FIG. 5.

FIG. 7 shows the thin hair holder device in operation and that once covered with hair, the device is imperceptible to observers when worn under the wearer's hair.

Figure 9:
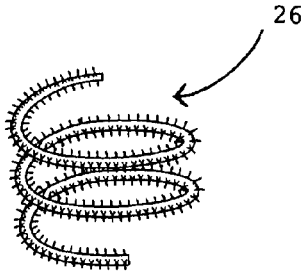
FIG. 9 shows a second embodiment of the hair holder device having a helix structure.
Figure 10:
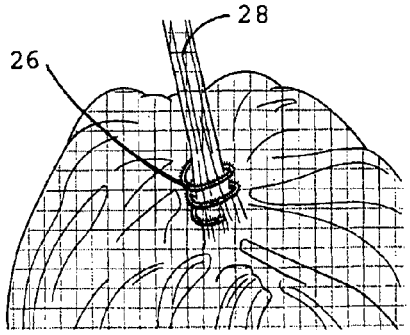
FIG. 10 shows use in hair of the helix hair holder device of FIG. 9.

FIGS. 9 and 10 show another embodiment of the thin hair holder device 26 wherein the device has a helix shape. The helix shape permits the drawing or passing of hair 28 through the thin hair holder device, such as shown in FIG. 10, to thus obtain better holding power and thereby lift the hair away from the scalp creating hair volume. The helix-shaped device 26 is constructed in the same manner as the device 10 as shown in FIG. 1. The wire can be of a rigidity that allows the wire to essentially maintain the helix configuration.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A hair holding and volume enhancing device comprising a first flat bendable strip of material having a first longitudinal side edge and substantially smooth surface and a second longitudinal side edge and surface with bristles extending therefrom, a second flat bendable strip of material having a first longitudinal side edge and substantially smooth surface and a second longitudinal side edge and surface with bristles extending therefrom; and a bendable shape-retaining wire;

wherein said first strip of material is attached to said second strip of material with said wire positioned therebetween to provide a body, so as when the strips attach together the wire being positioned between and along the first side edges of the first strip and the second strip of material, said second surface with bristles of each of said first strip of material and said second strip of material facing outward of said body, and wherein said hair holding and volume enhancing device is structured and arranged to increase hair volume of a user of said device by raising hair strands into a suspended position when such are enmeshed in said bristles.

2. The device of claim 1, wherein said body has a color compatible to hair color of the user of the device.

3. The device of claim 1, wherein the body has a length and a width such that the length is greater than the width.

4. The device of claim 1, wherein the first strip of material is attached to the second strip of material by sewing.

5. The device of claim 1, wherein the wire is interwoven with said first strip of material and said second strip of material.

6. The device of claim 1, wherein said body comprises a helix configuration.

7. A method of holding hair and enhancing hair volume using the device of claim 1, comprising placing the device in hair of a wearer, bending the device in any direction, and covering the device with hair of the wearer, in a manner that the hair is held by said bristles in said suspended position away from said scalp.

8. A hair holding and volume enhancing device comprising a flat bendable strip of material being configured to have a first side and a second side, wherein the strip of material has a length and width with the length being greater than the width, and wherein each of said first side and said second side has a first longitudinal edge and substantially smooth surface and a second longitudinal edge and surface with bristles extending outward therefrom; and a bendable shape-retaining wire positioned between said first side and said second side of said flat bendable strip of material and extending along said length of said flat bendable strip of material so that when the first side and the second side of the strip of material attach together, the wire is positioned between and along the first edges of the first side and the second side of the material;

wherein said bristles are structured and arranged to grasp hair strands of a user and raise said hair strands into a suspended position away from a scalp of the user whereby said hair holding and volume enhancing device increases hair volume of the user by suspension of said hair strands.

9. The device of claim 8, wherein said strips of material and said bristles have a color compatible to hair color of the user of the device.

10. The device of claim 8 wherein said device has a helix configuration.

11. A method of holding hair and enhancing hair volume using the device of claim 8, comprising placing the device in hair of a wearer, bending the device in any direction, and covering the device with hair of the wearer, in a manner that the hair is held by said bristles in said suspended position away from said scalp.

* * * * *